US008045745B2

(12) United States Patent
Horigome et al.

(10) Patent No.: US 8,045,745 B2
(45) Date of Patent: Oct. 25, 2011

(54) EDGE SUPPORT FOR A SPEAKER APPARATUS COMPRISING MULTIPLE RIDGES

(75) Inventors: Minoru Horigome, Yamagata (JP); Teruaki Kaiya, Yamagata (JP); Yuichi Takahashi, Yamagata (JP)

(73) Assignees: Pioneer Corporation, Tokyo (JP); Tohoku Pioneer Corporation, Tendo-shi, Yamagata (JP)

( * ) Notice: Subject to any disclaimer, the term of this patent is extended or adjusted under 35 U.S.C. 154(b) by 1087 days.

(21) Appl. No.: 11/601,840

(22) Filed: Nov. 20, 2006

(65) Prior Publication Data

US 2007/0127768 A1 Jun. 7, 2007

(30) Foreign Application Priority Data

Nov. 21, 2005 (JP) ..... P2005-336356

(51) Int. Cl.

| | |
|---|---|
| ***H04R 1/00*** | (2006.01) |
| ***H04R 9/06*** | (2006.01) |
| ***H04R 11/02*** | (2006.01) |
| *H04R 1/02* | (2006.01) |
| *H04R 7/00* | (2006.01) |
| *G10K 13/00* | (2006.01) |

(52) U.S. Cl. ..... 381/398; 381/386; 381/395; 381/396; 181/171; 181/172

(58) Field of Classification Search ..... 381/398, 381/184, 186, 342, 386, 395, 396; 181/171–172
See application file for complete search history.

(56) References Cited

U.S. PATENT DOCUMENTS

2005/0141746 A1 6/2005 Kobayashi et al.

FOREIGN PATENT DOCUMENTS

| | | | |
|---|---|---|---|
| EP | 0 914 020 | | 5/1999 |
| EP | 1 411 747 | | 4/2004 |
| EP | 1411747 | A2 * | 4/2004 |
| EP | 1 549 107 | | 6/2005 |
| EP | 1549107 | A2 * | 6/2005 |
| GB | 1 271 539 | | 4/1972 |
| JP | 55-51029 | | 4/1980 |
| JP | 55-80996 | | 6/1980 |
| JP | 58-43699 | | 3/1983 |
| JP | 61-116499 | | 6/1986 |
| JP | 63-155900 | | 6/1988 |
| JP | 2000-217192 | | 8/2000 |
| JP | 2004-7331 | | 1/2004 |
| JP | 2004-128840 | | 4/2004 |
| JP | 2005-191746 | | 7/2005 |
| WO | WO 2004/017673 | | 2/2004 |
| WO | WO 2004017673 | A1 * | 2/2004 |

OTHER PUBLICATIONS

Summons to Attend Oral Proceedings Pursuant to Rule 115(1) EPC issued in counterpart EP patent application No. 06124444.8 dated May 30, 2011.

* cited by examiner

*Primary Examiner* — Davetta Goins
*Assistant Examiner* — Matthew Eason
(74) *Attorney, Agent, or Firm* — Drinker Biddle & Reath LLP

(57) ABSTRACT

According to an embodiment of the invention, there is provided a speaker apparatus includes: a voice coil bobbin; and a diaphragm that is vibrated by the voice coil bobbin, the diaphragm including an edge portion at an outer circumference of the diaphragm, the edge portion including at least two ridge portions protruding forward.

5 Claims, 5 Drawing Sheets

EMBODIMENT 1

COMPARATIVE EXAMPLE

EMBODIMENT 1

COMPARATIVE EXAMPLE

EDGE SUPPORT FOR A SPEAKER APPARATUS COMPRISING MULTIPLE RIDGES

CROSS-REFERENCE TO RELATED APPLICATIONS

This application is based upon and claims the benefit of priority from Japanese Patent Application No. 2005-336356, filed Nov. 21, 2005, the entire contents of which are incorporated herein by reference.

BACKGROUND OF THE INVENTION

1. Field of the Invention

The present invention relates to a speaker apparatus.

2. Description of the Related Art

A general example of a dynamic speaker apparatus includes: a magnetic circuit; a frame holding the magnetic circuit at back thereof; a cone-shaped diaphragm having a circumferential rolled edge fixed on the front portion of the frame; and a voice coil wound on a cylindrical voice coil bobbin being axially movable. The voice coil bobbin is elastically supported by the frame through a damper for regulating the axial movement. The damper to be adopted usually has a bellows structure, which is concentric to the voice coil bobbin (e.g., JP-A-63-155900).

SUMMARY OF THE INVENTION

In recent years, more car-mounted audio systems incorporate a speaker apparatus reproducing heavy/low sound, such as a woofer or subwoofer.

In the car-mounted speaker apparatus, it is important to reduce the thickness of the speaker apparatus so that the speaker apparatus may be accommodated even in a portion where the depth dimension is limited, such as the door or ceiling panel of a vehicle.

As disclosed in JP-A-63-155900, such speaker apparatus in which the vibration system is supported by the damper is to be long in the axial direction and to have a high stiffness in the vibration system, so that the supporting performance of the vibration system is easily lowered by the mechanical fatigue. JP-A-2005-191746 discloses a damper less speaker apparatus having the configuration as shown in FIG. 1, in which the sealed space is formed, in place of the damper, between a pair of diaphragms so that the vibration system is supported by the gas in the sealed space.

Here, FIG. 1 shows a speaker apparatus, which is bilaterally symmetric with respect to a centerline 37, and only a half portion on one side of the centerline 37.

The speaker apparatus, as shown in FIG. 1, includes: a magnetic circuit 33 having a magnet 53; a frame 35 holding the magnetic circuit 33; a cylindrical voice coil bobbin 45 arranged axially movably with respect to the magnetic circuit 33; a voice coil 46 so wound on the voice coil bobbin 45 as to confront the magnetic circuit 33; a diaphragm 41 arranged along in the drive direction; and a drive member 42 (hereinafter referred to as drive cone) for transmitting the drives of the voice coil 46 to the diaphragm 41. The space that is defined by the diaphragm 41, the drive cone 42 and the frame 35, is a sealed space, so that the vibration system is supported by the spring property of the gas in the sealed space 67. Numeral 51 designates a yoke holding the magnet 53, and numeral 23 designates a dust cap for covering the central portion of the diaphragm 41 on the front face of the speaker apparatus.

The outer circumferences of the diaphragm 41 and the drive cone 42 are provided with curved portions having a generally semicircular longitudinal section called the "roll edges". The flange portions 61*a* and 62*a* extending from the outer ends of those roll edges 61 and 62 are fixed on the frame 35. The dimensions and shapes of the roll edges 61 and 62 relate not only to the protruding front dimension of the speaker apparatus but also to the volume of the sealed space 67, the effective vibration areas of the diaphragm 41 and the drive cone 42, and so on. Therefore, the dimensions and shapes of the roll edges 61 and 62 influence the frequency characteristics of the speaker apparatus.

In the speaker apparatus shown in FIG. 1, however, the roll edge 61 of the diaphragm 41 is formed into such a semicircle with a curvature radius R that the center point A of the curvature radius is positioned at the same height (H0) as that of the face of the flange portion 61*a* leading to the roll edge 61. The roll edge 62 of the drive cone 42 is the so-called "tall edge", in which the center point B of the curvature radius is located closer to the edge bulging portion than the flange portion 62*a* leading to that roll edge 62.

As described the above, the inside of the closed space between the diaphragms serves as the air spring, and the volume of the closed space influences the spring constant, i.e., the stiffness. Moreover, the effective vibration area difference between the diaphragm and the drive cone forming the sealed space relates to the stiffness. When the diaphragm has an effective vibration area S1, the drive cone has an effective vibration area S2 and the closed space has a volume V, the spring constant of the air spring in the sealed space is proportional to (S1−S2)/V. Also, when the spring constant is designated s0 and the vibration system has a weight m0, the lowest resonance frequency fo is expressed by $fo=(1/2\pi)\times\sqrt{(s0/m0)}$. Therefore, the lowest resonance frequency can be lowered by decreasing the spring constant s0.

For decreasing the spring constant to lower the lowest resonance frequency, therefore, it is necessary to decrease the effective vibration area difference between the diaphragm and the drive cone. For this, one method is to make the roll edge of the diaphragm on the front face side of the device into an edge shape having a large curvature radius. However, when the curvature radius of the roll is enlarged, the edge becomes taller to enlarge the axial length of the speaker apparatus, i.e., the protruding dimension of the edge from the diaphragm mounting face, thereby the speaker apparatus fails to be thin. In addition, there are restrictions on the specifications of the speaker apparatus, such as the roll diameter and roll length of the roll edge, which are caused by the diameter of the speaker apparatus (i.e., the mounting diameter), the draught of the frame and so on.

On the other hand, EP0914020A2 describes the configuration of a corrugation damper, in which the corrugations are formed on the drive cone side. However, this constitution reduces the effective vibration area on the drive cone side thereby the support by the air spring is stiff.

The present invention has made in view of the above circumstances and provides a speaker apparatus. According to an aspect of the invention, there is provided a speaker apparatus in which the support of a diaphragm is softened without enlarging the roll diameter (or the protrusion dimension of the front face) of the edge in the speaker apparatus for supporting the vibration system with the air spring in the sealed space between the diaphragm and the drive cone.

According to an aspect of the invention, there is provided a speaker apparatus including: a voice coil bobbin; and a diaphragm that is vibrated by the voice coil bobbin, the diaphragm including an edge portion at an outer circumference of the diaphragm, the edge portion including at least two ridge portions protruding forward.

BRIEF DESCRIPTION OF THE DRAWINGS

FIG. 6A plots the measurement results of Embodiment 1; and FIG. 6B plots the measurement results of Comparative example.

FIG. 7A plots the measurement-results of Embodiment 1; and FIG. 7B plots the measurement results of Comparative example.

DETAILED DESCRIPTION OF THE INVENTION

Embodiment 1

A speaker apparatus according to Embodiment 1 of the invention is described in the following with reference to the accompanying drawings.

Figure 2:
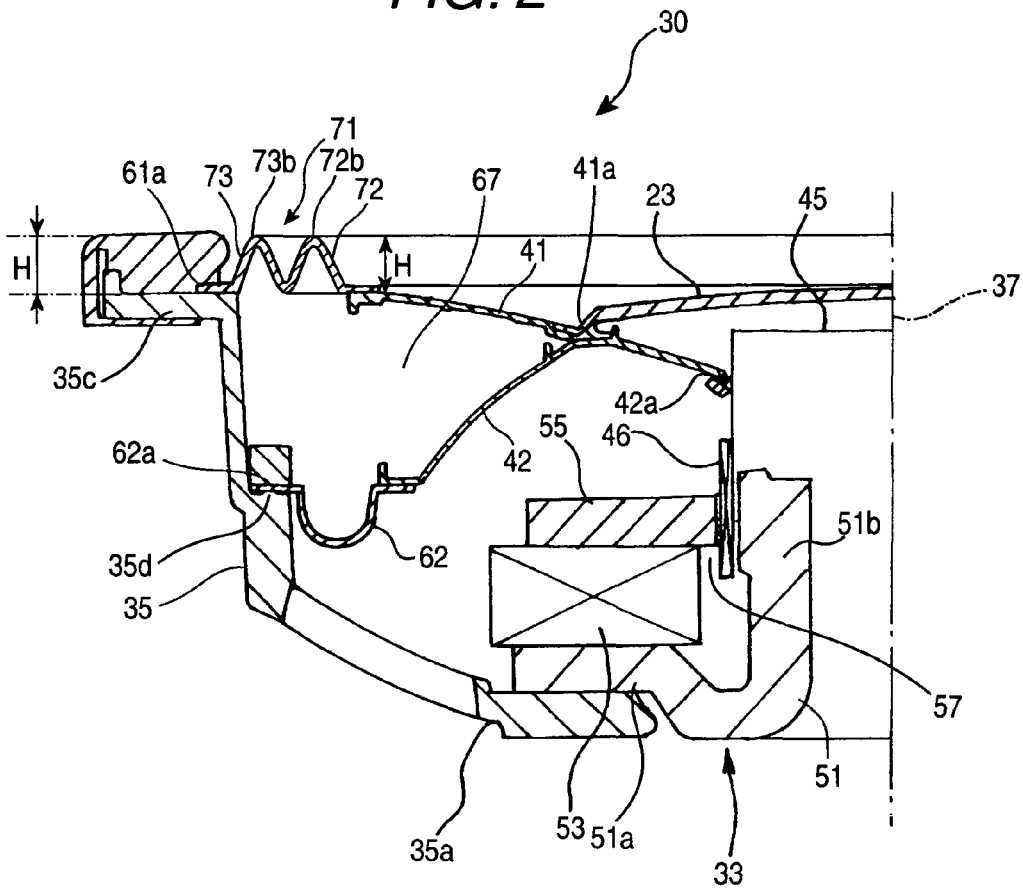
FIG. 2 is a longitudinal section showing a half portion of the speaker apparatus according to Embodiment 1 of the invention.
Figure 3:
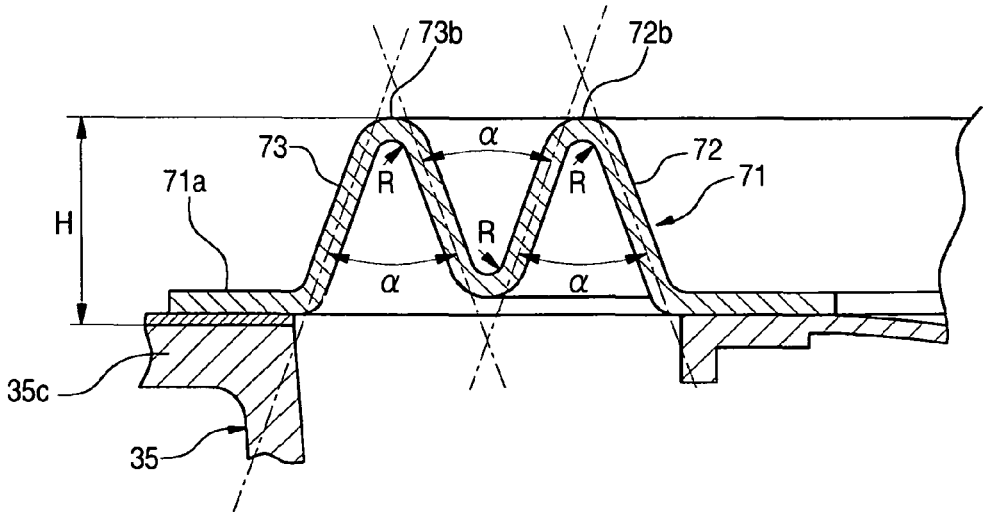
FIG. 3 is an enlarged sectional view of a relevant portion of the speaker apparatus shown in FIG. 2.

FIG. 2 is a longitudinal section of the speaker apparatus according to Embodiment 1 of the invention. Here in this embodiment, the speaker apparatus is presented as one half in a sectional view because it is bilaterally symmetric in this embodiment. Moreover, FIG. 3 is an enlarged sectional view of a relevant portion of FIG. 2.

As shown in FIG. 2, a speaker apparatus 30 of this embodiment includes: a magnetic circuit 33; a frame 35 having the magnetic circuit 33 attached to rear inner wall thereof; a diaphragm 41 arranged along a drive direction; a drive cone 42 for transmitting the vibration of a voice coil 46 to the diaphragm 41; and the voice coil 46 wound on a cylindrical voice coil bobbin 45. The speaker apparatus 30 is configured to support a vibration system by the air spring in a closed space 67 that is defined by the diaphragm 41, the drive cone 42 and the frame 35. The vibration system includes the diaphragm 41, the drive cone 42, the voice coil bobbin 45, a roll edge 62, an edge 71 and a dust cap 23. Incidentally, numeral 37 designates the centerline of the speaker apparatus 30.

The magnetic circuit 33 includes: a yoke 51 having a configuration, in which a cylindrical center pole 51*b* is protruded at the center of a disc-shaped plate 51*a*; a ring-shaped magnet 53 so disposed as to surround the center pole 51*b*; and a ring-shaped top plate 55 so disposed on the leading end side of the center pole 51*b* as to interpose the magnet 53 between the top plate 55 and the plate 51*a*. The gap between the inner circumference of the top plate 55 and the center pole 51*b* is a magnetic gap 57 for arranging the voice coil 46.

The frame 35 is formed into a shallow-bottomed cup shape, and the magnetic circuit 33 is so attached that a bottom plate portion 35*a* mounts the plate 51*a* of the yoke 51 on the inner face of the bottom plate portion 35*a*.

This frame 35 is provided, at positions spaced in the driving direction, with a diaphragm supporting portion 35*c* of the diaphragm 41 and a drive cone supporting portion 35*d* of the drive cone 42.

The diaphragm 41 and the drive cone 42 are cone-shaped diaphragms. An edge 71 of the outer circumference of the diaphragm 41 is a corrugated edge, which has two ridge portions 72 and 73 having the same height H (that is, the top portions 72*b* and 73*b* have the same height) bulging to the outer side of the closed space 67 between the diaphragms (that is, to the front face side of the speaker apparatus). A roll edge 62 at the outer circumference portion of the drive cone 42 is a tall edge bulging to the outer side of the closed space 67 between the diaphragms (that is, to the back side of the speaker apparatus).

The diaphragm 41 and the drive cone 42 are fixed on the diaphragm supporting portion 35*c* and the drive cone supporting portion 35*d* on the frame 35 at mounting flange portions 71*a* and 62*a* respectively extending from the outer ends of the edge 72 and the roll 62 of their outer circumference portions.

According to this constitution, the height H of the edge 71 of the diaphragm 41 can be reduced to thin the speaker apparatus 30. Moreover, the reflection at the edge can be reduced to reduce the disturbance of the impedance. Moreover, the effective length of the edge 71 can be enlarged to allow a sufficient margin for amplitudes of the diaphragm 41. As a result, the power of an input signal can be sufficiently coped with, even if raised, to reproduce a high sound quality with little distortion. Because of easy amplification, moreover, the lowest resonance frequency fo is lowered to usefully improve the acoustic characteristics of the speaker apparatus for reproducing low sounds, such as a woofer or subwoofer.

The edge 71 is equipped with a meshed reinforcing member all over its whole face of the inside of foamed urethane. According to the above configuration, the edge can attain a sufficient strength and can be easily deformed in response to the dislocation of the diaphragm.

Here, this reinforcing member is formed of aromatic polyamide fibers, cotton, polyester fibers, olefin group fibers or nylon fibers, for example. On the other hand, the reinforcing member is made by any one of plain, hexagonal and triaxial weaves, and is either nonwoven or triaxial cloth.

Moreover, the reinforcing member is sandwiched between the films of a thermoplastic resin and the foamed urethane and the reinforcing member are fused through heat pressure shaping.

In Embodiment 1, the edge 71 has a thickness of about 1 mm, for example, each of the ridge portions 72 and 73 has an apex angle that is configured to be within a range from 50 degrees to 65 degrees, and has a curvature radius R of about 1.5 mm. When the apex angle $\alpha$ is in this range, the mesh mounted as the reinforcing member does not break the foamed urethane, but the reinforcing member can make the strength raising function compatible while keeping the elastic properties of the ridge portions 72 and 73.

The diaphragm 41, as arranged on the front face side of the speaker apparatus 30, has the diameter of the central opening larger than that of the opening of the drive cone 42. Also, the drive cone 42, as arranged on the back of the diaphragm 41, has the diameter of the central opening equal to the external diameter of the voice coil bobbin 45.

On the other hand, the diaphragm 41 has inner circumference portion 41*a* so jointed to the drive cone 42 as is overlapped on the drive cone 42 positioned at the back thereof.

Moreover, a dust cap 23 is adhered to the central portion of that diaphragm 41. This dust cap 23 covers the front of the voice coil bobbin 45 thereby to prevent dust or the like from invading into the magnetic gap 57.

By adhering and fixing the inner circumference portion 42*a* of the drive cone 42 to the outer circumference of the voice coil bobbin 45 suitably by an adhesive or the like, the diaphragm 41 is enabled to acquire the configuration, in which it is connected through the drive cone 42 to the voice coil bobbin 45.

The cylindrical voice coil bobbin 45 is so freely fitted on the outer circumference of the center pole 51*b* as to move in the axial direction, and is positioned in the radial direction and in the axial direction by the drive cone 42 jointed to the outer circumference of the voice coil bobbin 45.

The edge 71 of the diaphragm 41 and the roll edge of the drive cone 42 attenuate the vibrations transmitted from the cone paper or the diaphragm body. It is, therefore, preferred to use a member of a material having a high internal loss. Therefore, the edge 71 and the roll 62 may be prepared by jointing a member of a material different from a material of the cone paper (that is, a material having a higher internal loss than that of the cone paper).

Figure 1:
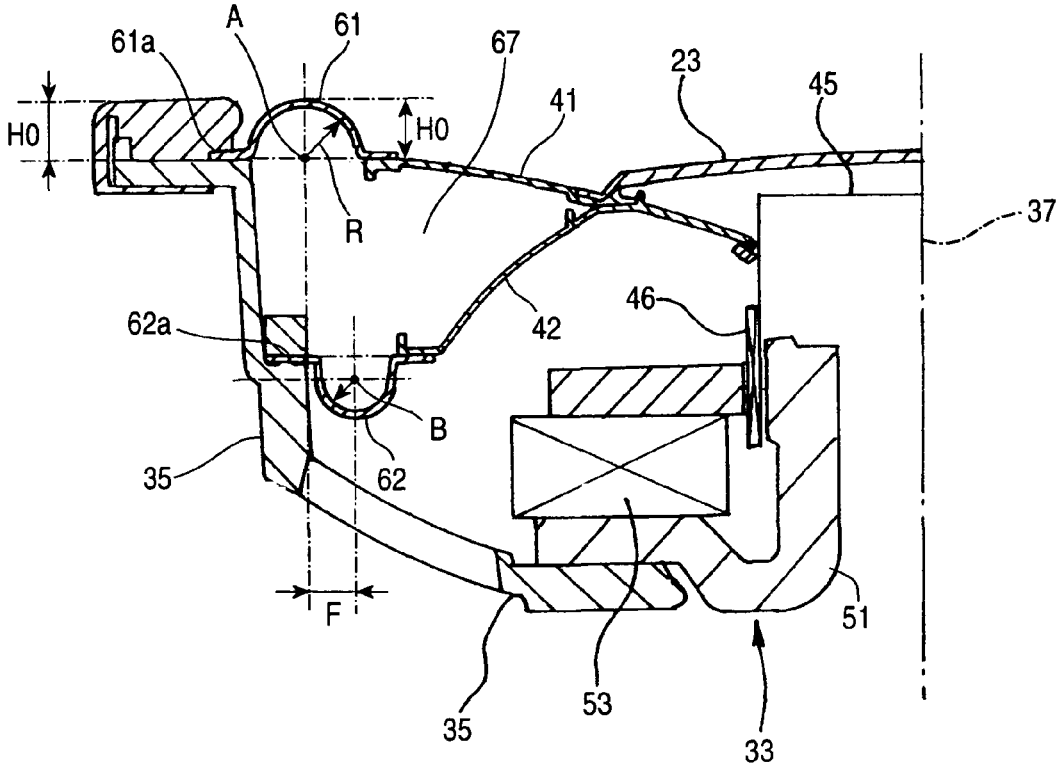
FIG. 1 is a longitudinal section showing a half portion of a speaker apparatus, in which outer circumference of the diaphragm is constituted of a roll edge.

Here are presented the examples of the measurement results of the acoustic characteristics of the speaker apparatus of Embodiment 1 of the invention and the speaker apparatus of Comparative example (that is, the speaker apparatus shown in FIG. 1).

Here, Embodiment 1 had an edge height H of 8.5 mm, an edge effective length of 39.59 mm and an apex angle of 60 degrees, and Comparative example used the speaker apparatus having the edge configuration of the related art, as shown in FIG. 1, and had an edge height H of 12.0 mm and an edge effective length of 36.23 mm.

Figure 6A:
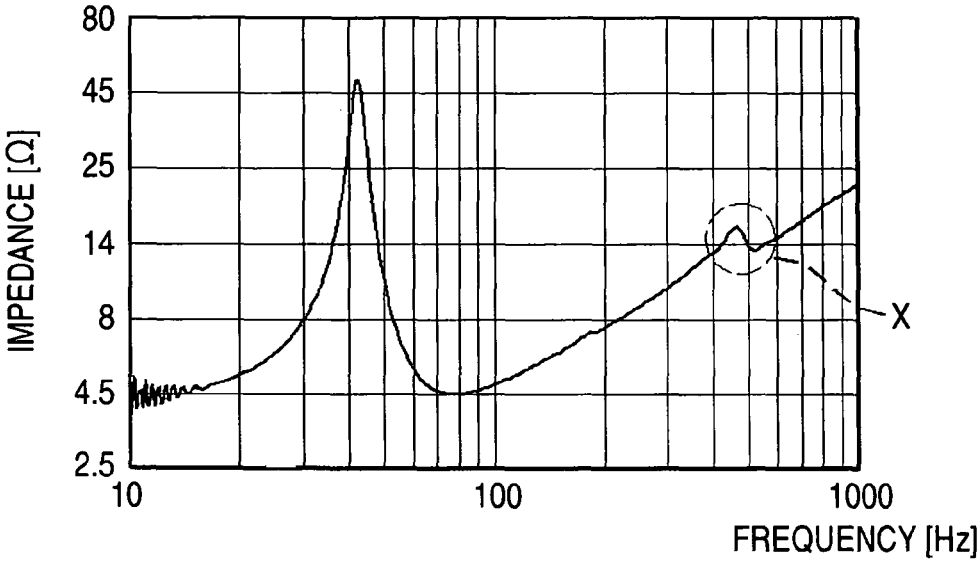
FIGS. 6A and 6B present graphs plotting the measurement results of the frequency characteristics of the impedance, for the speaker apparatuses.
Figure 6B:
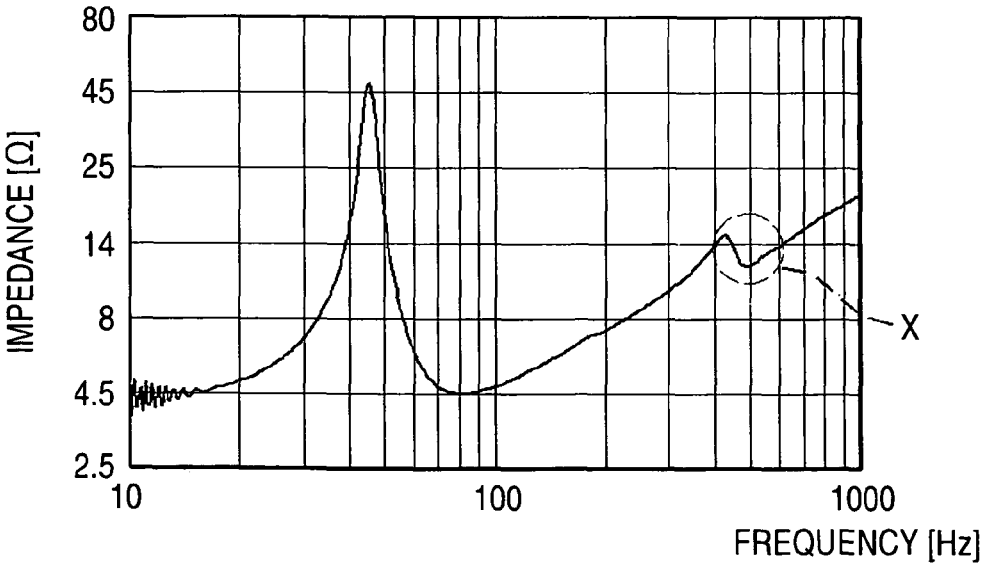

FIGS. 6A and 6B present graphs plotting the measurement results of the frequency characteristics of the impedance, for the speaker apparatus of Embodiment 1 and the speaker apparatus of Comparative example (that is, the speaker apparatus shown in FIG. 1). FIG. 6A plots the measurement results of Embodiment 1, and FIG. 6B plots the measurement results of Comparative result.

It is found, as shown in FIGS. 6A and 6B, that the speaker apparatus of Embodiment 1 has less disturbances in the impedance characteristics within the range of a frequency of 450 Hz to 500 Hz (that is, the range, as indicated by X in the drawings) than those of the speaker apparatus of Comparative example.

For the speaker apparatus of Embodiment 1 and the speaker apparatus of Comparative example, moreover, the measurements of a power linearity indicating the relations of the output sound pressure to the input power (or the input electric power) were performed at the frequencies of 30 Hz, 40 Hz and 50 Hz in a low sound range.

Figure 7A:
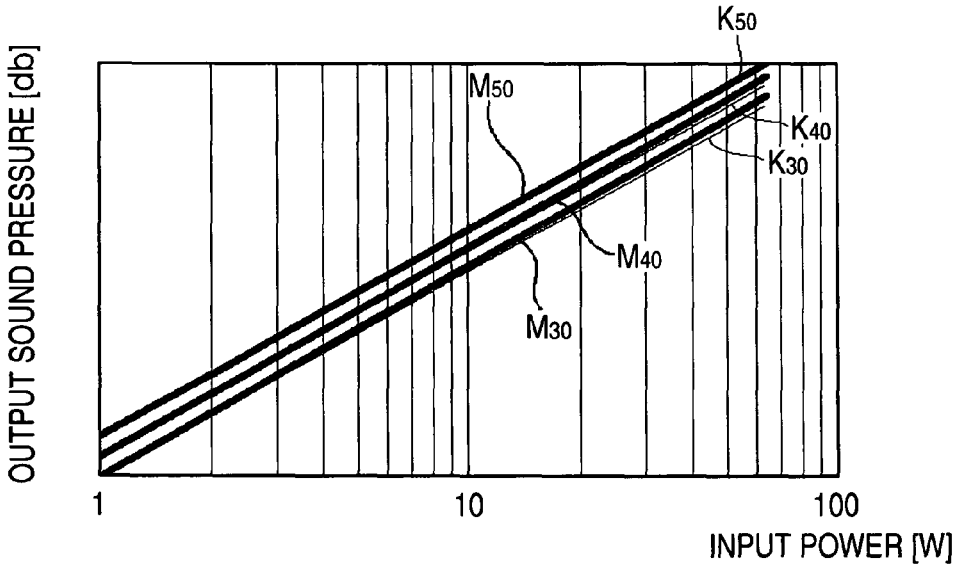
FIGS. 7A and 7B present graphs plotting the measurement results of power linearity.
Figure 7B:
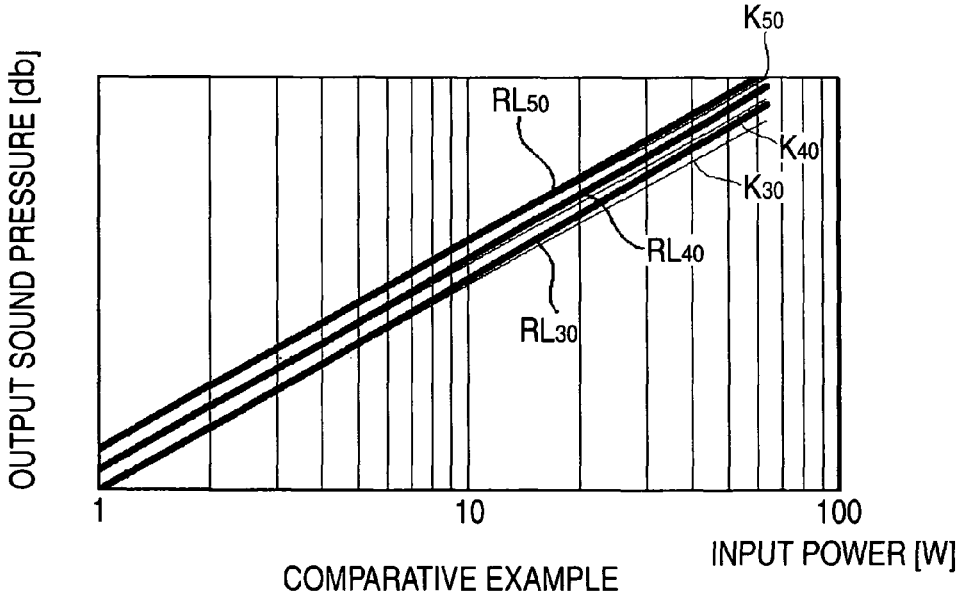

FIGS. 7A and 7B presents graphs plotting the measurement results of the power linearity. FIG. 7A plots the measurement results of Embodiment 1, and FIG. 7B plots the measurement results of Comparative example.

In FIG. 7A, the measured values for the individual frequencies of 30 Hz, 40 Hz and 50 Hz in the speaker apparatus of Embodiment 1 are indicated by lines of $M_{30}$ (30 Hz), $M_{40}$ (40 Hz) and $M_{50}$ (50 Hz), and the ideal lines of the power linearity are indicated by thin lines of $K_{30}$ (30 Hz), $K_{40}$ (40 Hz) and $K_{50}$ (50 Hz).

In FIG. 7B, on the other hand, the measured values for the individual frequencies of 30 Hz, 40 Hz and 50 Hz in the speaker apparatus of Comparative example are indicated by lines of $RL_{30}$ (30 Hz), $RL_{40}$ (40 Hz) and $RL_{50}$ (50 Hz), and the ideal lines of the power linearity are indicated by thin lines of $K_{30}$ (30 Hz), $K_{40}$ (40 Hz) and $K_{50}$ (50 Hz).

As seen from drawings, the speaker apparatus of Embodiment 1 (FIG. 7A) has the results closer to the lines ($K_{30}$, $K_{40}$ and $K_{50}$) indicating the ideal characteristics for the individual frequencies than those of Comparative example (FIG. 7B).

Moreover, the lowest resonance frequency fo was 40 Hz for the speaker apparatus of Comparative example but 32 Hz for the speaker apparatus of Embodiment 1.

Embodiment 2

A speaker apparatus according to Embodiment 2 of the invention is described in the following with reference to FIG. 4.

Figure 4:
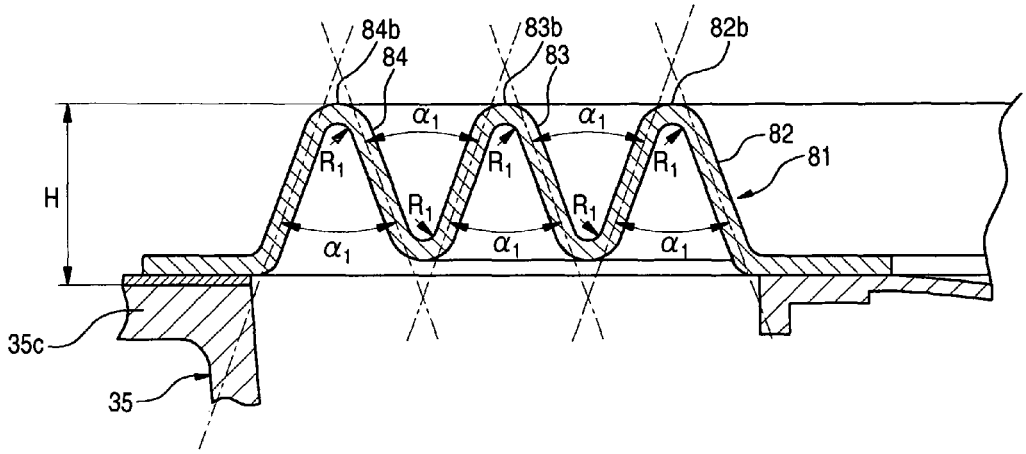
FIG. 4 is an enlarged section view of a relevant portion of the speaker apparatus according to Embodiment 2 of the invention.

FIG. 4 is an enlarged section view of an edge 81 in the speaker apparatus of Embodiment 2 according to the invention. Other configuration of Embodiment 2 is omitted from their description, because they are similar to those of Embodiment 1.

In Embodiment 2, the diaphragm 41 and the drive cone 42 are cone-shaped diaphragms. The edge 81 of the outer circumference of the diaphragm 41 is a corrugated edge, which has three ridge portions 82, 83 and 84 having the same height H (that is, the top portions 82*b*, 83*b* and 84*b* have the same height) bulging to the outer side of the closed space 67 between the diaphragms (that is, to the front face side of the speaker apparatus). Moreover, all the curvature radii R1 of the ridge portions 82, 83 and 84 are configured to have an identical dimension.

Embodiment 2 can also acquire effects similar to those of Embodiment 1.

Embodiment 3

A speaker apparatus according to Embodiment 3 of the invention is described in the following with reference to FIG. 5.

Figure 5:
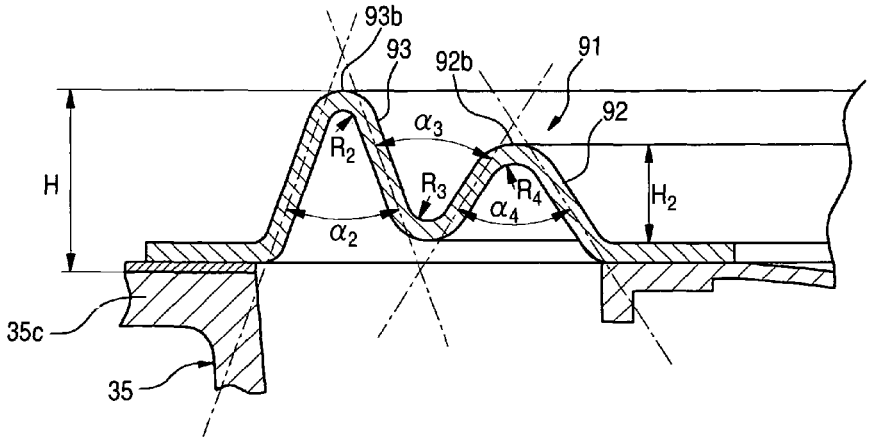
FIG. 5 is an enlarged section view of a relevant portion of the speaker apparatus according to Embodiment 3 of the invention.

FIG. 5 is an enlarged section view of an edge 91 in the speaker apparatus of Embodiment 3-according to the invention. Other configuration of Embodiment 3 is omitted from their description, because they are similar to those of Embodiment 1.

In Embodiment 3, the diaphragm 41 and the drive cone 42 are cone-shaped diaphragms. The edge 91 of the outer circumference of the diaphragm 41 is a corrugated edge, which has two ridge portions 92 and 93 bulging to the outer side of the closed space 67 between the diaphragms. These two ridge portions 92 and 93 are formed to have different heights H2 (at a top portion 92*b*) and the height H (at a top portion 93*b*). The curvature radii R2, R3, R4 of the ridge portions 92 and 93 are configured to have different dimensions, and all apex angles $\alpha$2, $\alpha$3 and $\alpha$4 are also different from one another. With these constitutions, Embodiment 3 can not only acquire effects like those of Embodiments 1 and 2 but also adjust the dimensions of the ridge portions so that the setting contents can be adjusted by fine-tuning the functions.

As has been thus far described in detail, the speaker apparatus 30 according to the embodiment of the invention can reduce the height of the edge of the diaphragm in the double-cone (i.e., the diaphragm and the drive cone) speaker apparatus using the air suspension, thereby to promote the reduction of the thickness of the speaker apparatus. Thus, it is possible to provide a speaker apparatus such as a car-mounted speaker apparatus, which can be easily mounted on the portion such as the door or ceiling panel of a car of a limited depth. Moreover, the effective length of the edge can be enlarged to give the diaphragm a margin for the amplitude and to cope with the power, even if raised, of an input signal sufficiently, thereby to reproduce a high sound quality with little distortion. Because of realizing larger excursion, moreover, the frequency fo is lowered to usefully improve the acoustic characteristics of the speaker apparatus for reproducing low frequency sounds, such as a woofer or subwoofer.

Here, the speaker apparatus according to the invention should not be limited to the speaker apparatus of the double cone (that is, the diaphragm and the drive cone) using the air suspension of the aforementioned embodiments but can be applied to other various speaker apparatuses. Moreover, the edge configuration should not be limited to the shapes of the aforementioned embodiments but can be modified in various manners.

According to an embodiment of the invention the edge constituting the outer circumference portion of the diaphragm to be vibrated by the vibration of the voice coil has the undulate shape having the two or more ridge portions protruding toward the speaker front face in the transverse section view.

According to the configuration, not only the height of the edge of the diaphragm can be reduced to thin the speaker apparatus, but also the reflection at the edge can be reduced to reduce the disturbance of the impedance. Moreover, the effective length of the edge can be enlarged to allow a sufficient margin for amplitudes of the diaphragm. As a result, the power of an input signal can be sufficiently coped with, even if raised, to reproduce a high sound quality with little distortion. Because of easy amplification, moreover, the lowest resonance frequency fo is lowered to usefully improve the acoustic characteristics of the speaker apparatus for reproducing low sounds, such as a woofer or subwoofer.

According to the embodiments, the edge may be configured to have a meshed reinforcing member in the inside of foamed urethane. According to the configuration, the edge can attain a sufficient strength and can be easily deformed in response to the dislocation of the diaphragm.

According to the embodiments, the ridge portions may be configured to have an apex angle that is configured to be within a range from 50 degrees to 65 degrees. According to the configuration, it is possible to provide a speaker apparatus, in which both the elastic function and the strength raising function of the ridge portions are made compatible to reproduce the so-called "high sound quality" and to have the durability.

Moreover, according to the embodiments, a drive cone is included for transmitting the drives of the diaphragm and the voice coil to the diaphragm. The diaphragm and the drive cone are fixed at their outer circumferences to a diaphragm supporting portion on a frame. The space defined by the diaphragm, the drive cone and the frame is a sealed space. And a vibration system is supported through a voice coil bobbin by the spring property of a gas in the sealed space.

According to the configuration, in the double-cone (i.e., the diaphragm and the drive cone) speaker apparatus using the air suspension, the height of the edge of the diaphragm can be reduced to promote the reduction of the thickness of the speaker apparatus. Thus, it is possible to provide a speaker apparatus such as a car-mounted speaker apparatus, which can be easily mounted on the portion such as the door or ceiling panel of a car of a limited depth. Moreover, the effective length of the edge can be enlarged to give the diaphragm a margin for the amplitude and to cope with the power, even if raised, of an input signal sufficiently, thereby to reproduce a high sound quality with little distortion. Because of easy amplification, moreover, the frequency fo is lowered so that the acoustic characteristics of the speaker apparatus for reproducing low sounds, such as the woofer or subwoofer can be improved.

What is claimed is:

1. A speaker apparatus comprising:

a diaphragm having an effective vibration area S1; and a drive cone having an effective vibration area S2, wherein:

outer circumferences of the diaphragm and the drive cone are fixed to supporting portions of a frame via a first edge and a second edge respectively;

a closed space defined by the diaphragm and the drive cone, the closed space has a volume V;

a spring constant of an air spring in the closed space is proportional to (S1−S2)/V; and the first edge includes at least two ridge portions protruding forward so the spring constant is reduced by reducing a value of (S1−S2); and the at least two ridge portions begin at the outer circumference of the diaphragm;

wherein each of the ridge portions has an apex angle that is configured to be within a range from 50 to 65 degrees.

2. The speaker apparatus according to claim 1, wherein the edge portion includes a foamed urethane having a meshed reinforcing member therein.

3. A speaker apparatus comprising:

a voice coil bobbin;

a frame having first and second supporting portions;

a diaphragm including an edge portion at an outer circumference of the diaphragm fixed to the first supporting member; and a drive member arranged coaxially with the diaphragm along a driving direction, the drive member being connected to the diaphragm, the outer circumference of the drive member fixed to the second supporting member, the drive member transmitting a vibration of the voice coil bobbin to the diaphragm;

wherein the frame, the diaphragm and the drive member define a closed space, wherein a vibration system is supported by spring property of a gas included in the closed space, wherein the edge portion includes at least two ridge portions protruding frontward wherein the at least two ridge portions begin at the outer circumference of the diaphragm, and wherein each of the ridge portions has an apex angle that is configured to be within a range from 50 to 65 degrees.

4. The speaker apparatus according to claim 1, wherein a lowest resonance frequency is lowered by decreasing the spring constant.

5. The speaker apparatus according to claim 1, wherein:

an inner circumference of the drive cone is fixed to a voice coil bobbin; and an inner circumference of the diaphragm is fixed to the drive cone.

* * * * *